US006061931A

United States Patent [19]

Kaneko

[11] Patent Number: 6,061,931

[45] **Date of Patent: *May 16, 2000**

[54] SOLES FOR TRACK-AND-FIELD ATHLETIC SHOES

[75] Inventor: Yasunori Kaneko, Osaka, Japan

[73] Assignee: Mizuno Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,580

[22] Filed: Jun. 14, 1996

[30] Foreign Application Priority Data

Jun. 16, 1996 [JP] Japan ..... 7-174163

[51] Int. Cl.[7] ..... A43B 5/06

[52] U.S. Cl. ..... 36/129; 36/59 R; 36/67 R

[58] Field of Search ..... 36/129, 59 R, 36/67 R

[56] References Cited

FOREIGN PATENT DOCUMENTS 2-98703 8/1990 Japan .

5-63308 8/1993 Japan .

5-72801 10/1993 Japan .

6-24505 4/1994 Japan .

*Primary Examiner*—Ted Kavanaugh

*Attorney, Agent, or Firm*—Evenson, McKeown, Edwards & Lenahan, PLLC

[57] ABSTRACT

By analyzing the force which acts during actual running from a bio mechanical perspective and determining the most preferable positions of spikes on the shoe sole, spikes can be arrayed only in necessary positions and not in unnecessary positions so as to further lessen weight and also provide rigidity to the region wherein spike placement is voided, so as to deal with unwanted flexion of the shoe sole. A shoe sole for spiked track-and-field athletic shoes has spikes located only in positions corresponding to the heads of the metatarsals and in positions corresponding to the distal phalanxes. The shoe sole regions between the spikes arrayed in positions corresponding to the heads of the metatarsals and in positions corresponding to the distal phalanxes are provided with an appropriate rigidity.

2 Claims, 5 Drawing Sheets

SOLES FOR TRACK-AND-FIELD ATHLETIC SHOES

BACKGROUND OF THE INVENTION

1. Field of the Invention

The present invention relates to a shoe sole for spiked track-and-field athletic shoes used mainly in track events.

2. Description of Related Art

Generally, track-and-field athletic shoes used for track events are fitted with spikes only on the forefoot portion of the sole.

While there are many innovations being made by the various manufacturers, the spikes generally have been arrayed on the sole throughout the entire forefoot portion.

Particularly, in recent years, effort has been made to attach as many spikes as possible within the 11 spikes which is permitted under event regulations, in order to exhibit greater kick power on so-called all-weather tracks which employ a synthetic resin paving material.

In doing so, there are known track-and-field athletic shoes which focus on the load path, which is how the bodily weight acts on the shoe soles during running action, and place spikes on this load path. However, such shoes as these have spikes arrayed throughout the sole area, and in this respect, are no different to the conventional items.

Arraying spikes through the sole region leads to increased weight of the spikes, and also leads to inhibited flexibility of the shoe sole due to the shoe sole being thickened.

When the force which acts during actual running is analyzed from a bio mechanical perspective, it has become clear that the conventional idea of attaching as many spikes as regulations will allow to the sole of the shoes in order to obtain greater kick force, was fundamentally mistaken.

The excessive spikes attached to the shoe sole not only hang up on the track against the intentions of the runner, thereby obstructing natural movement of the legs, but also may decrease kick power in some cases.

SUMMARY OF THE INVENTION

The present invention has been made in order to analyze the force which acts during actual running from a bio mechanical perspective, and determine the optimal arrangement of spikes on a shoe sole.

In doing so, the object is to array spikes in necessary positions so as to gain kick power, and to remove spikes from unnecessary positions so as to further lighten the shoe. Further, rigidity is provided to the region wherein spike placement is void, so as to deal with unwanted flexion of the shoe sole.

In order to solve these problems, the present invention provides a shoe sole for spiked track-and-field athletic shoes used mainly in track events. The spikes are located only in positions corresponding to the heads of the metatarsals and in positions corresponding to the distal phalanxes. A rigidity is provided to the shoe sole region between the spikes arrayed in positions corresponding to the heads of the metatarsals and in positions corresponding to the distal phalanxes.

It is desirable to situate 2 to 5 spikes at positions corresponding to the heads of the metatarsals, and 1 to 4 spikes at positions corresponding to the distal phalanxes.

Also, rigidity is provided to the shoe sole region between the spikes arrayed in positions corresponding to the heads of the metatarsals and in positions corresponding to the distal phalanxes by either adhering onto the aforementioned region an insert member which possesses a greater bending rigidity than the shoe sole proper or by making the aforementioned region thicker than other regions.

In the shoe sole for track-and-field athletic shoes according to the present invention, the spikes located in positions corresponding to the heads of the metatarsals take the force immediately after the shoe lands on the track, and prevents the shoe from slipping forwards.

Next, when the shoe is powerfully kicked toward the rear in order to take the next step, the spikes located in positions corresponding to the distal phalanxes prevent the shoe from sliding backwards, and act to change the kick force to forward motion with certainty.

Since there are no spikes attached to the shoe sole region between the positions corresponding to the heads of the metatarsals and the positions corresponding to the distal phalanxes, there are no excessive spikes hanging up on the track against the intentions of the runner. Accordingly, natural flexion for the repetitive rolling action of the feet in running is encouraged; without obstructing natural movement of the legs, and without decreasing kick power.

Moreover, since the number of spikes can be reduced, the weight of the entire shoe can be lightened, making for a light and effective shoe in sprint events where 1/100 of a second makes a difference.

Since rigidity is provided to the shoe sole region between the positions corresponding to the heads of the metatarsals and the positions corresponding to the distal phalanxes where no spikes are located, there is no trouble of this region flexing to an abnormal degree and thereby dropping. Accordingly, increased fatigue on the feet of the runner and unexpected injuries are avoided.

Further, by allowing for the rigidity of this portion to be adjustable, a shoe can be made which possesses rigidity to the liking of the runner.

DESCRIPTION OF THE PREFERRED EMBODIMENTS

Figure 5:
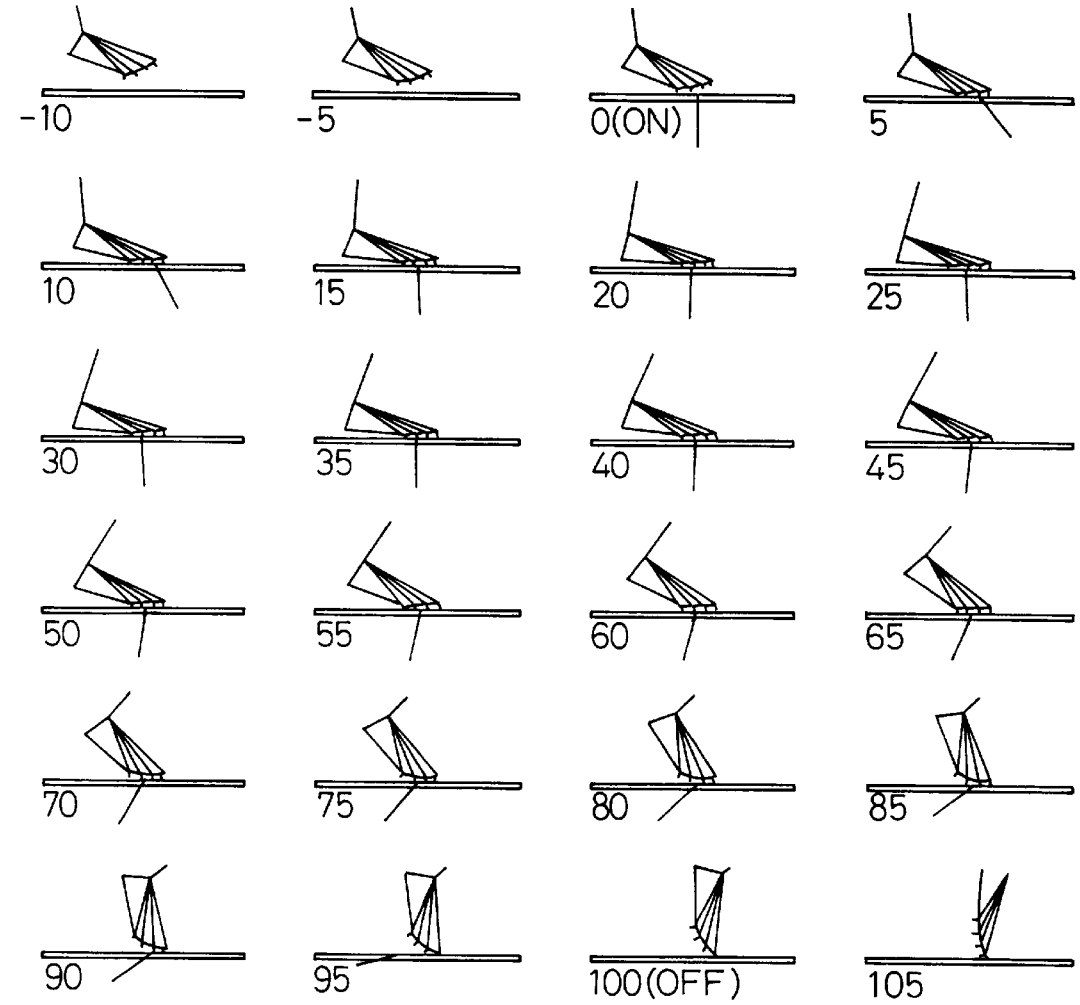
FIG. 5 is a diagram showing the direction of force exerted on the track by track-and-field athletic shoes from a position before landing on the track, up to leaving the track.

First, when the force which acts during actual running was analyzed from a bio mechanical perspective, the results were as shown in FIG. 5.

FIG. 5 is a figure showing how force is exerted on the track in increments of 5/1000 seconds in the flow (time sequence) of track-and-field athletic shoes from a position before landing on the track, landing on the track, kicking rearwards, and the finally leaving the track and stepping forward for the next step.

Figure 6:
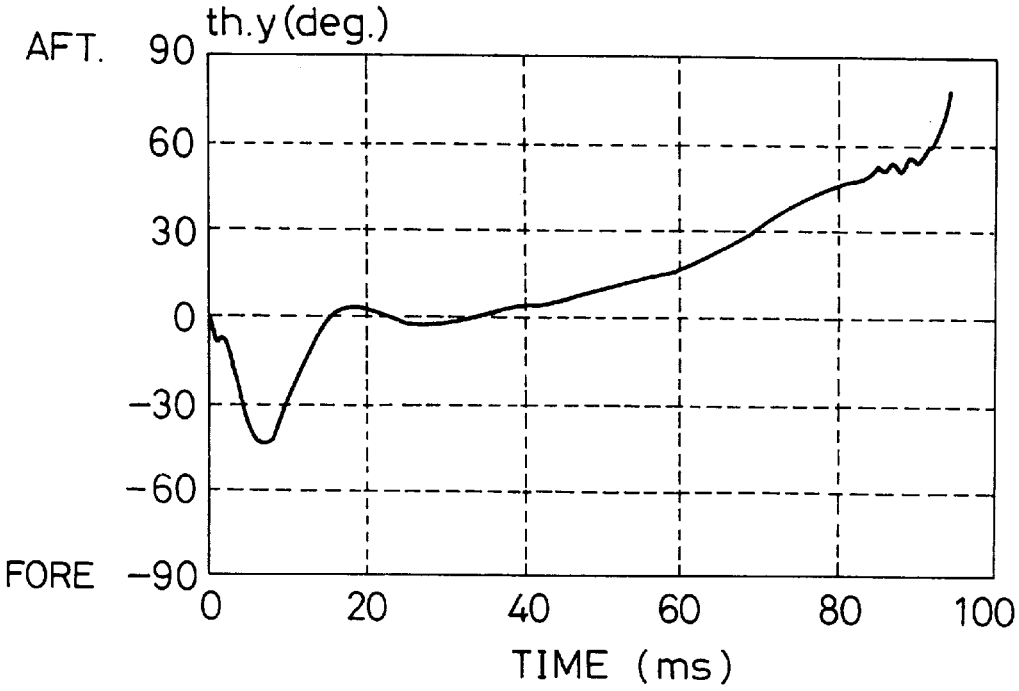
FIG. 6 is a diagram showing the direction of force shown in FIG. 5 in a time sequence, with 0° being a direction perpendicular to the ground (track).

FIG. 6 is a diagram showing the direction of force shown in FIG. 5 in a time sequence, with 0° being a direction perpendicular to the ground (track).

As can be seen from FIG. 6, the force exerted on the ground in the instant of landing is in a perpendicular direction to the ground, and the immediately changes to a force which is up to over −40° (in this instance the minus symbol indicates force being exerted in the forward direction) as compared to the perpendicular direction to the ground.

This force soon returns to a perpendicular direction to the ground, and remains at a perpendicular direction to the ground for a relatively long period of time thereafter. Then this force at a perpendicular direction to the ground gradually begins to possess a positive angle (i.e., angle of kick in the rear direction), and in the instant of kicking to the rear, suddenly exceeds +60°.

Now, when the track-and-field athletic shoes are exerting force on the ground at a perpendicular direction thereto (i.e., when the angle in FIG. 6 is exactly 0°), there is no horizontal force acting on the track. Accordingly, regarding this time, there will be no slippage on the track, regardless of whether there are spikes or no spikes.

However, when the force the track-and-field athletic shoes are exerting on the ground at a perpendicular direction, shifts to an angle (i.e., when the angle in FIG. 6 is other than 0°), three is force acting either in the forward horizontal or rear horizontal direction on the track. This force is the cause of the track-and-field athletic shoes slipping.

Theoretically, if the static friction coefficient is 0, the track-and-field athletic shoe would slip even if the force thereof shifted to a horizontal direction by even 1°, as compared to being at a perpendicular direction; however, this does not occur in practice.

Figure 7:
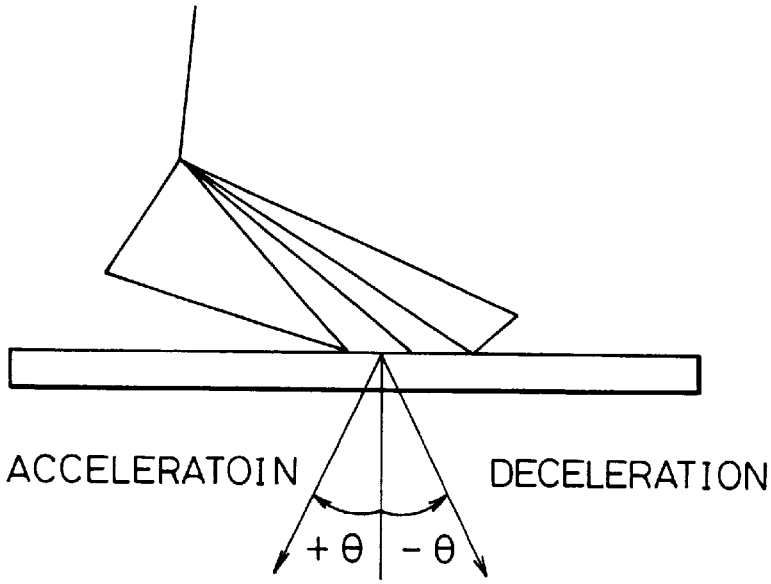
FIG. 7 is a diagram showing the force exerted on the ground by track-and-field athletic shoes.

As shown in FIG. 7, the track-and-field athletic shoe does not slip on the track until the force of the track-and-field athletic shoe acting on the ground exceeds a certain angle ±θ. When this angle ±θ is calculated, the static friction coefficient between synthetic resin paving material such as synthetic rubber or urethane, and shoe sole material such as polyamide (nylon) is approximately 0.6 in a wet state, which means that there is no slippage so long as the angle is within around 30°.

In other words, there is no slippage of track-and-field athletic shoe even without spikes, as long as the force the track-and-field athletic shoes are exerting on the ground is within ±30° as compared to that of a perpendicular direction.

Now, returning to FIG. 6 again, force being exerted by the track-and-field athletic shoe on the track with an angle exceeding 30° as compared to being perpendicular to the ground occurs in two stages: of the instant of landing, and the last stage where the track-and-field athletic shoe is kicked rearwards strongly and then leaves the ground to take the next step. This means that the shoe will not slip at other times even without spikes.

Accordingly, it can be seen that the spikes which are necessary for track-and-field athletic shoes are only spikes to prevent the shoe from slipping forward immediately following landing, and spikes to prevent the shoe from slipping backwards when kicking in a rearwards direction before the shoe leaves the track.

An idea which focuses on this is Japanese Utility Model Laid Open No. 2-98703.

This idea notes only the slippage when kicking strongly in a rearwards direction before the shoe leaves the track, and the forward slippage immediately after the shoe lands in ignored. Accordingly, while force is transferred to the track without loss when kicking the shoe in a rearwards direction, there has been a problematic situation wherein the shoe shifts in a forward direction upon landing, thereby losing balance in running.

Figure 1:
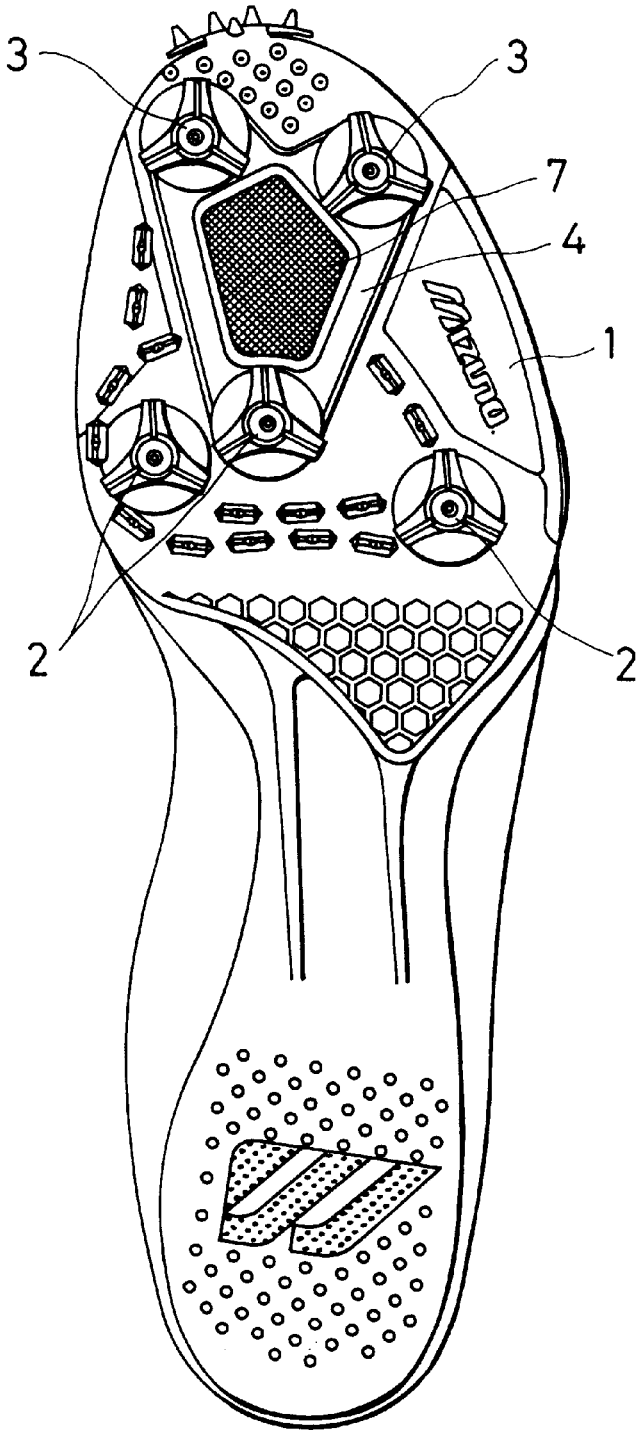
FIG. 1 is a shoe sole for track-and-field athletic shoes relating to the present invention.

FIG. 1 is an embodiment of the track-and-field athletic shoe sole 1 according to implementation of the present invention, based on the aforementioned bio mechanical theory.

Based on the load path theory, it is known that in sprint events, first, the position corresponding to the heads of the metatarsals land and force is exerted on this position, and then the body weight gradually shifts forward to reach the positions corresponding to the distal phalanxes, there is the kicking action, and the foot leaves the ground (track).

Figure 4A:
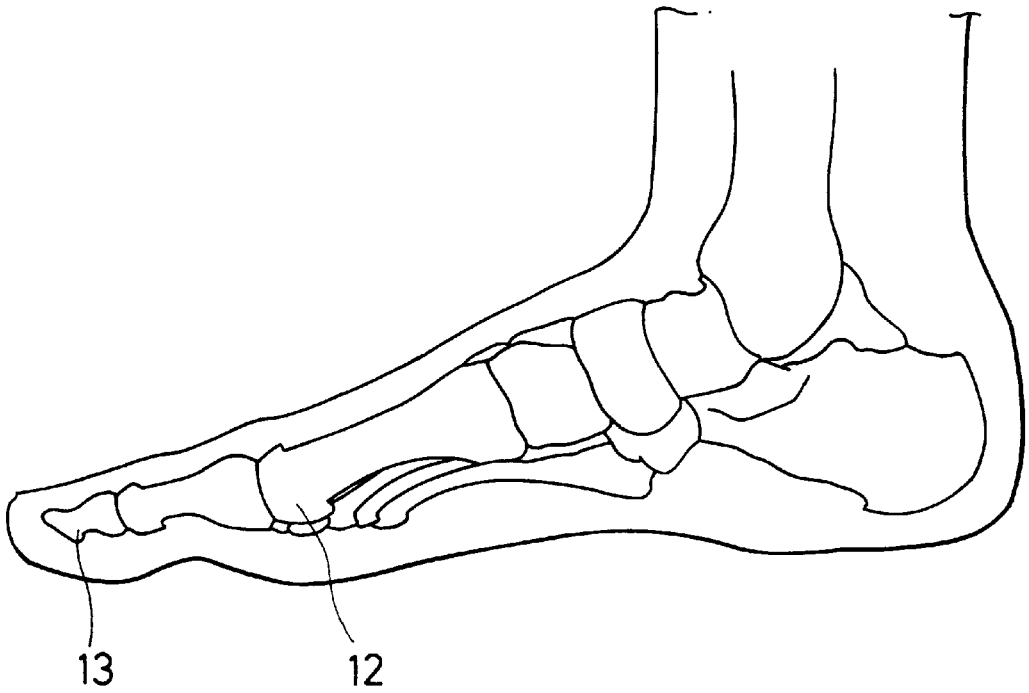
FIG. 4 is an explanatory diagram showing the feet bones.
Figure 4B:
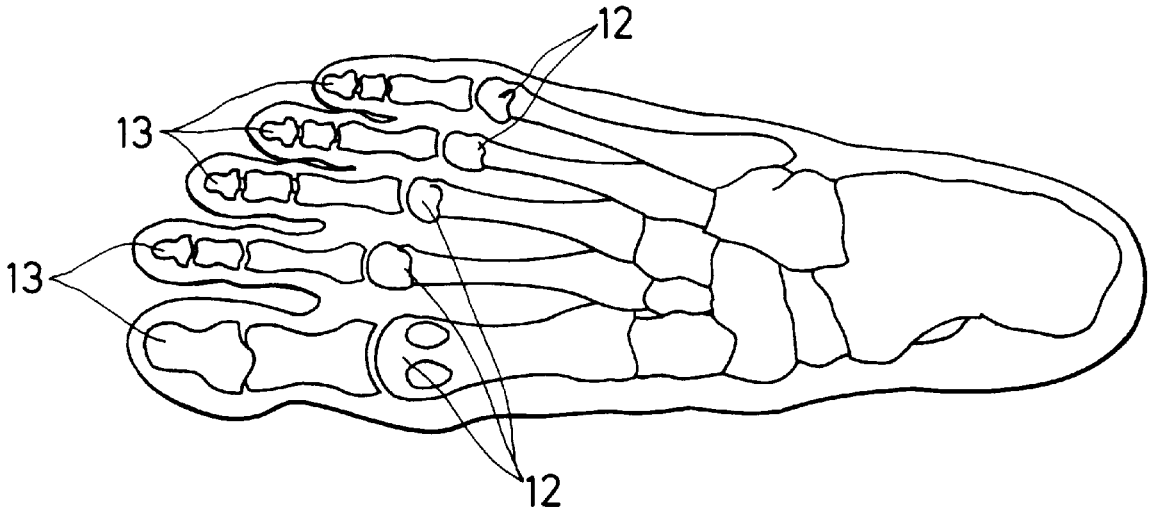

The heads of the metatarsals 12 and the distal phalanxes 13 are shown in FIG. 4.

Here, the present invention prevents the shoe slipping forwards by situating spikes 2 at the position corresponding to the heads of the metatarsals where force is exerted immediately after landing.

Further, spikes 3 are situated in positions corresponding to the distal phalanxes where force is exerted when kicking strongly in a rearwards direction before the shoe leaves the track, thereby preventing the shoe slipping in a backwards direction.

In FIG. 1, 3 spikes 2 are situated at the position corresponding to the heads of the metatarsals, and 2 spikes 3 are situated in positions corresponding to the distal phalanxes, but the number of spikes is not confined to that of this embodiment. It is desirable that the number of spikes 2 be 2 to 5 spikes at positions corresponding to the heads of the metatarsals, and 1 to 4 spikes at positions corresponding to the distal phalanxes. If the number of spikes is less than the aforementioned, the stability of the shoe in landing is impaired. Also, if the number of spikes is greater than the aforementioned, the spikes will not all fit in the aforementioned region and will be situated outside thereof, making for hanging up on the track against the intentions of the runner, and is not desirable.

Further, the form of the spikes 2 and the spikes 3 may be identical.

The shoe sole region between the spikes 2 arrayed in positions corresponding to the heads of the metatarsals and the spikes 3 arrayed in positions corresponding to the distal phalanxes is the region 4 which is provided with rigidity.

Specifically, an insert member 7 which possesses a greater bending rigidity than the shoe sole 1 proper is adhered onto the region 4.

Examples of the insert member 7 which possesses a greater bending rigidity than the shoe sole 1 proper include the following: GFRTP (Glass Fiber Reinforced Thermo Plastic), CFRTP (Carbon Fiber Reinforced Thermo Plastic), BFRTP (Boron Fiber Reinforced Thermo Plastic), KFRTP (Keratin Fiber Reinforced Thermo Plastic), and other thermo plastics using organic fibers or inorganic fibers are reinforcement.

Figure 2:
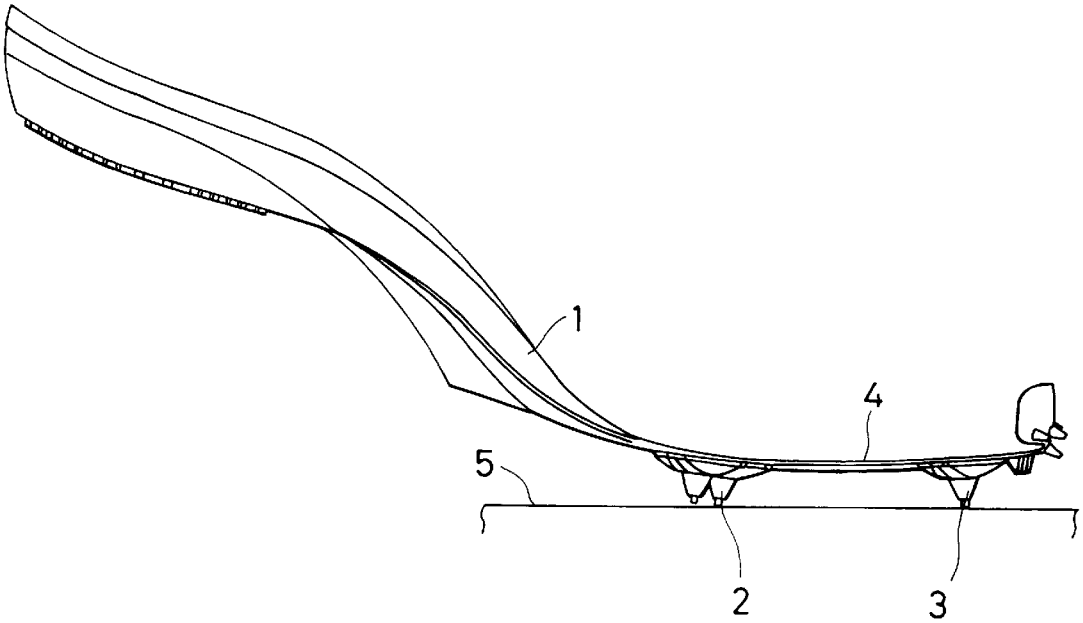
FIG. 2 is a side view of FIG. 1.
Figure 3:
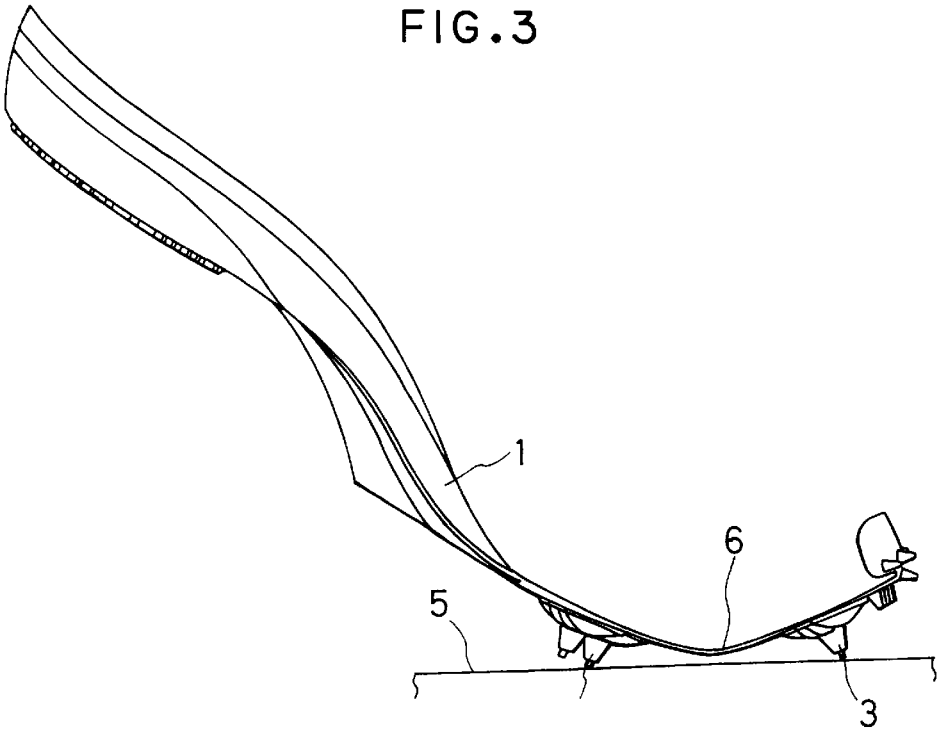
FIG. 3 in an explanatory diagram of usage of a shoe which is not provided with a rigid region.

FIG. 3 describes the problems which occur in the event that spikes 2 and 3 are situated only in positions corresponding to the heads of the metatarsals and in positions corresponding to the distal phalanxes, as shown in FIG. 1. In this explanatory diagram, there is no area provided with rigidity 4 between the spikes 2 and 3, unlike the embodiment of the present invention shown in FIG. 1 and FIG. 2.

In the event that there is no area provided with rigidity 4, when the shoe lands on a track 5 of synthetic resin paving material, the spikes 2 and 3 do not completely pierce the track 5, and the great spacing between the spikes 2 and the spikes 3 which is without rigidity flexes 6 to an extreme degree. This not only causes loss of force during running, but also was a concern that the muscles on the plantar of the feet might unexpectedly stretch, resulting in an injury.

FIG. 2 is a side view of the shoe sole of the present embodiment according to the present invention shown in FIG. 1. Since the area between the spikes 2 and the spikes 3 is made to be a region provided with rigidity 4 by means of inserting an insert member 7 which possesses greater rigidity than the shoe sole 1 proper, there is no trouble of this region dropping to an abnormal degree. Accordingly, loss of force during running and injuries to feet muscles can be prevented.

Further, as means other than the aforementioned means to realize providing of rigidity to the area between the spikes 2 and the spikes 3, the thickness of the shoe sole in this region 4 may be made thicker than other regions.

Also, while in FIG. 1 an insert member 7 is adhered in a general triangular form to an area between one of the spikes 2 located in a position corresponding to a head of a metatarsal and two of the spikes 3 located in positions corresponding to the distal phalanxes, thereby making a region provided with rigidity 4, the means for providing rigidity is not limited to such. For example, rigidity nay be provided to the entire area between spikes 2 and spikes 3, or rigidity may be provided to the portion of the area between spikes 2 and spikes 3, or further, rigidity may be provided to the area between spikes 2 and spikes 3, in the form of two or more rib formations.

The same can be said for the Case where the thickness of the shoe sole between the spikes 2 and spikes 3 is made to be thicker than other regions so as to possess rigidity.

EFFECTS OF THE INVENTION

The shoe sole for track-and-field athletic shoes according to the present invention has been made, based on bio mechanics, to be such that spikes 2 and 3 are located only in positions corresponding to the heads of the metatarsals and in positions corresponding to the distal phalanxes, so as to prevent the shoe from sliding backwards with certainty, and there is no loss of kick force.

Further, since there are no spikes attached to unnecessary positions, only to the aforementioned positions, there is no hanging up of spikes on the track against the intentions of the runner. Accordingly, natural flexion for the repetitive rolling action of the feet in running is encouraged, without obstructing natural movement of the legs, and effective acceleration motion can be realized thereby.

Moreover, since the number of spikes can be reduced, the weight of the entire shoe can be lightened, making for a light and effective shoe in sprint events where 1/100 of a second makes a difference.

Since the shoe sole region between the spikes 2 at the positions corresponding to the heads of the metatarsals and the spikes 3 at the positions corresponding to the distal phalanxes is made to be a region provided with rigidity 4, there is no trouble of this region flexing to an abnormal degree, and increased fatigue on the feet and unexpected injuries are avoided.

I claim:

1. A shoe sole for track-and-field athletic shoes used mainly in track events comprising:

spikes located only in positions corresponding to heads of metatarsals and in positions corresponding to distal phalanxes of a foot of a user, and an insert member having a greater resistance to bending than other portions of said shoe sole and providing rigidity to a narrow shoe sole region confined between the spikes located in positions corresponding to the heads of the metatarsals and the spikes located in positions corresponding to the distal phalanxes.

2. A shoe sole for track-and-field athletic shoes used mainly in track events comprising:

spikes located only in positions corresponding to heads of metatarsals and in positions corresponding to distal phalanxes of a foot of a user, and a thickened sole portion having a greater resistance to bending than other portions of said shoe sole and providing rigidity to a narrow shoe sole region confined between the spikes located in positions corresponding to the heads of the metatarsals and the spikes located in positions corresponding to the distal phalanxes .

* * * * *